United States Patent [19]

Williams

[11] Patent Number: 4,774,778

[45] Date of Patent: Oct. 4, 1988

[54] FABRIC ALIGNING APPARATUS FOR EMBROIDERY

[76] Inventor: Thomas Williams, 1145 E. Main St., Lakeland, Fla. 33801

[21] Appl. No.: 69,241

[22] Filed: Jul. 2, 1987

[51] Int. Cl.[4] ..... D05C 1/04

[52] U.S. Cl. ..... 38/102.2; 112/78

[58] Field of Search ..... 38/102.2; 160/380; 112/78, 83, 102, 103

[56] References Cited

U.S. PATENT DOCUMENTS 4,411,208 10/1983 Nishida et al. ..... 38/102.2

4,644,639 2/1987 Atteberry et al. ..... 38/102.2

*Primary Examiner*—Ronald Feldbaum

*Attorney, Agent, or Firm*—Frijouf, Rust & Pyle

[57] ABSTRACT

An apparatus and method is disclosed for aligning a fabric prior to securing the fabric in a hooping frame. The apparatus comprises a platform with a first hooping frame holding means disposed on the platform. The first hooping frame holding means provides for an aligned mounting of the hooping frame relative to a second hooping frame holding means of an embroidery machine. A target alignment pattern is positioned in a manner to be displayed through an opening of the hooping frame when the hooping frame is positioned in the first hooping frame holding means to enable in use the fabric to be aligned when the fabric is positioned relative to a point on the target alignment pattern prealigned with the embroidery needle of the embroidery machine while the hooping frame is simultaneously held by the first hooping frame holding means in the alignedly mounted position to enable exact positioning of an embroidery at the prealigned point thereby enabling placement of an aligned embroidery on the fabric when the fabric is secured in the hooping frame and the hooping frame which secures the fabric is positioned in an aligned second hooping frame holding means of the embroidery machine and the fabric is embroidered.

16 Claims, 4 Drawing Sheets

FABRIC ALIGNING APPARATUS FOR EMBROIDERY

BACKGROUND OF THE INVENTION

1. Field of the Invention

The present invention relates to a fabric aligning apparatus and more specifically to an apparatus which permits precise alignment of a fabric, garment, or the like, prior to mounting the hooping framed fabric in the hooping frame holder of the embroidery machine in order that the fabric, garment or the like will receive an aligned embroidery pattern thereon.

2. Information Disclosure Statement

With the advent of multi-head embroidery machines which are capable of embroidering a desired pattern simultaneously on multiple fabrics each of which is positioned beneath one of the heads has resulted in an increase in embroidered fabrics such as garments and the like.

The present process for preparing a garment for receiving an embroidery is to position the hooping frame such that the intended location of the embroidery is positioned within the opening of the hooping frame, adjust the entire garment such that the location of the intended embroidery appears to be alignedly positioned within the opening of the hooping frame relative to the entire fabric and relative to the "X" axis and "Y" axis (horizontal and vertical positioning) on the fabric. The outer hooping frame is then secured to the fabric by placing an inner hooping frame over the fabric and securely positioning the fabric against the inner periphery of the outer hooping frame. The placement of the intended embroidery is then checked by visual examination and if properly aligned is secured to a hooping frame holding means on an embroidery machine. Generally, to expedite the process the embroidery stop-start point is always positioned at the center of the hooping frame opening.

What is needed is an apparatus which readily and rapidly enables the alignment of a fabric to enable an embroidery to be positioned such that the embroidery is positioned at a desired location relative the entire fabric and the embroidery is positioned such that the vertical and horizontal portions of the embroidery are correctly orientated on the fabric.

Accordingly, it is a primary object of this invention to provide an apparatus which overcomes the aforementioned difficulties of the prior art and provides an improvement which is a substantial contribution to the advancement of the embroidery art.

It is an object of this invention to provide an apparatus which provides for precise orientation of a fabric or garment prior to securing the fabric within a hooping frame to determine a precisely positioned point on the fabric or garment for an intended aligned embroidery pattern prior to mounting the fabric or garment into a hooping frame holding means of an embroidery machine.

It is a further object of this invention to provide an apparatus which provides for precise positioning of an embroidery on a fabric or garment.

It is a further object of this invention to provide an apparatus which provides for an alignment of a fabric or garment along a "X" axis and a "Y" axis prior to securing the fabric in a hooping frame.

It is a further object of this invention to provide an apparatus for aligning a fabric relative to an embroidering needle of an embroidery machine prior to securing the fabric in a hooping frame.

It is a further object of this invention to provide an apparatus which provides for alignment of a second hooping frame holding means of the embroidery machine which corresponds to the alignment of a first hooping frame holding means of the apparatus and provides for alignment of an embroidery needle of the embroidery machine which corresponds to a point on a target alignment pattern of the apparatus.

It is a further object of this invention to provide an apparatus having a fabric alignment pattern positioned in a manner to be displayed on a platform for aligning a point of the fabric relative to the intended embroidery position displayed on the target alignment pattern.

It is a further object of this invention to provide an apparatus which enables a fabric or garment held in a hooping frame to be aligned relative to the embroidery machine prior to positioning the hooping framed fabric or garment in the embroidery machine.

It is a further object of this invention to provide an apparatus which saves time in aligning a fabric, garment and the like prior to embroidering.

It is a further object of this invention to provide an apparatus which provides for the alignment of a fabric, garment, and the like among different embroidery machines thereby permitting a composite embroidery comprising a generic portion and a personalized portion wherein the generic portion of the composite embroidery may be embroidered on a multi-head embroidery machine and the personalized portion of the composite embroidery embroidered on a single-head machine.

It is a further object of this invention to provide an apparatus to provide for rapid hooping of the fabric in an aligned manner to provide for an aligned embroidery on the fabric.

It is a further object of this invention to provide an apparatus which provides for a target alignment pattern and a fabric alignment pattern wherein the fabric alignment pattern is positioned in a manner to be displayed on a platform for receiving the fabric and the target alignment pattern is positioned in a manner to be displayed through the opening of the hooping frame such that in use the concentric circles of the target alignment pattern tangently intersect the horizontal lines of the fabric alignment pattern.

It is a further object of this invention to provide an apparatus which provides a target alignment pattern having a bull's eye to aid in the alignment of a stop-start point of the embroidery relative to a point of reference, such as a pocket, a seam, a stripe or a placket, on the fabric, garment and the like.

It is an advantage of this invention to decrease embroidery machine down time between embroidery operations which is especially advantageous where multi-head machines are used to embroider.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

This invention is defined by the appended claims of the specific embodiment shown in the attached drawings. For the purpose of summarizing the invention, the invention relates to a fabric aligning apparatus and method for aligning a fabric prior to positioning the fabric in an embroidery machine. The apparatus for aligning a fabric prior to securing the fabric in a hooping frame having at least one positioning boss comprises a platform and a first hooping frame holding means having at least one notch for alignedly receiving each positioning boss of the hooping frame. The first hooping frame holding means being is on the platform for alignedly receiving in use the hooping frame relative to a corresponding alignment mounting in a second hooping frame holding means of an embroidery machine having at least one notch for alignedly receiving each positioning boss of the hooping frame. A target alignment pattern is positioned in a manner to be displayed through an opening of the hooping frame when the hooping frame is positioned in the first hooping frame holding means disposed on the platform. The apparatus enables in use the fabric to be aligned when the fabric is positioned relative to a predetermined point on the target alignment pattern prealigned with the embroidery needle of the embroidery machine while the hooping frame is simultaneously held by the first hooping frame holding means in the alignedly received position to enable exact positioning of an embroidery on the fabric positioned at the prealigned point. The apparatus of the invention enables placement of an aligned embroidery on the fabric when the fabric is secured in the hooping frame and the hooping frame which secures the fabric is positioned in the correspondingly aligned second hooping frame holding means of the embroidery machine and the fabric is embroidered.

In a further embodiment of the invention, the apparatus includes a fabric alignment pattern positioned in a manner to be displayed on the platform to enable in use the fabric to be aligned by positioning the fabric to be aligned relative to at least one point of reference on the fabric with at least one point on the fabric alignment pattern to enable an ascertainment of the position of the intended embroidery as defined by the fabric positioned over the point on the target alignment pattern prealigned with the embroidery needle of the embroidery machine.

Preferably, the platform includes a first end and a second end and the fabric alignment pattern defines a grid pattern. The grid pattern comprises a plurality of horizontal lines wherein the lines are horizontal relative to the first end and the second end of the platform. The horizontal lines of the grid pattern are uniformly spaced and parallel relative to an adjacent horizontal line of the plurality of horizontal lines. The grid pattern further includes a plurality of lines with each line of the plurality of lines uniformly spaced and parallel relative to an adjacent line of the plurality of lines and with each the line perpendicularly intersecting each horizontal line of the plurality of horizontal lines.

Most preferably, the target alignment pattern includes a cross hair pattern positioned in a manner to be displayed in use through the opening of the hooping frame when the hooping frame is positioned in the first hooping frame holding means disposed on the platform. A plurality of different sized concentric circles originate from a point of origin of the cross hair pattern such that each concentric circle of the plurality of different sized concentric circles tangently intersects each of two of the horizontal lines of the plurality of horizontal lines of the fabric alignment pattern.

In a further embodiment of the invention, the apparatus of the invention includes a platform and a plate (described below) which are transparent to light. Preferably, the apparatus further includes a light source positioned within the apparatus to enhance in use the display of the target alignment pattern and the fabric alignment pattern through the transparent platform plate and fabric being aligned thereby enhancing the observation of the target alignment pattern and of the alignment pattern on the fabric being aligned.

The apparatus of the invention further includes a platform having an upper surface and a lower surface with the light source being positioned proximate the lower surface of the platform to permit light generated by the light source to pass through the transparent platform. Preferably, the light source of the invention includes a proximate portion and a distal portion with the proximate portion positioned adjacent the lower surface of the platform. Most preferably, a reflective means, such as a mirror is positioned adjacent the distal portion of the light source to reflect the of the light generated by the light source through the transparent platform to further enhance the display of the target alignment pattern through the fabric.

The light source enables rapid alignment of the fabric in the hooping frame relative to the embroidery head of the embroidery machine because of the enhanced projection of the fabric alignment pattern and target alignment pattern on the fabric being aligned.

Preferably, the apparatus of the invention includes a fabric deflection member positioned at the second end of the platform which extends downwardly relative the platform from the lower surface of the platform. The fabric deflection member prevents the fabric to be aligned from entangling or hooking the upper member support, the light source and/or mirror, if present. Preferably, the fabric deflection member is attached to the mirror. The fabric deflection member results in an increased hooping rate.

In a further embodiment of the invention, the apparatus for aligning a fabric prior to securing the fabric in a hooping frame having at least one positioning boss relative to an embroidering head of an embroidery machine to enable specific orientation of an embroidery thereon comprises a frame having a first end and a second end with an upright member having a first end and a second end. The first end of the upright member is positioned at the second end of the frame and extends vertically from the frame. A platform having a first end and a second end with the first end of the platform supportably positioned at the second end of the upright member such that the platform is spaced apart from the frame to enable in use the passage a portion of the fabric to be aligned between the frame and the platform when the remaining portion of the fabric is alignedly positioned on the platform. The platform further includes an upper surface and a lower surface with an alignment pattern positioned in a manner to be displayed on the platform. A first hooping frame holding means is disposed on the platform for alignedly receiving in use the hooping frame relative to a corresponding alignment in a second hooping frame holding means of an embroidery machine. A target alignment pattern is positioned in a manner to be displayed through an opening of the hooping frame to enable in use the fabric to be aligned when the fabric is positioned relative to a point on the target alignment pattern prealigned with the embroidery needle of the embroidery machine while the hooping frame is simultaneously held by the first hooping frame holding means in the alignedly mounted position to enable exact positioning of an embroidery on the fabric positioned at the prealigned point thereby enabling placement of an aligned embroidery on the fabric when the fabric is secured in the hooping frame and the hooping frame which secures the fabric is positioned in the correspondingly aligned second hooping frame holding means of the embroidery machine and the fabric is embroidered.

In a further embodiment, the first hooping frame holding means defines a plate, preferably transparent to light, having an opening formed therein in the shape of the hooping frame in order to alignedly receive the hooping frame therein. The plate further includes a first end and a second end with the upper surface of the platform further including a first end and a second end. A first guide rail and a second guide rail are positioned at the first end and the second end of the platform, respectively, to slidably and guidably receive the first end and the second end of the plate, respectively, therebetween. The guide rails allow the plate to move in a plane parallel to the upper surface of the platform and between a third end and a fourth end of the platform. In use the plate is moved to a desired location between the third end and the fourth end of the platform in order to change the intended position of the embroidery on a plurality of similar fabrics. Once the plate is positioned at the desired location on the platform, it must be secured to prevent it from moving during the aligning process. Movement of the plate during the alignment process results in misaligned embroideries.

In an alternative embodiment of the invention the upper surface of the platform further includes a plurality of apertures formed therein. In use a first portion of the plurality of apertures defines a first hooping frame shape of a plurality of hooping frame shapes. A plurality of posts are used such that in use each aperture of the first portion of apertures of the plurality of apertures formed in the upper surface of the platform receives a post of the plurality of posts thereby forming an outline of the first hooping frame shape to alignedly receive the first hooping frame shape therein. This enables the aligned positioning of different shaped hooping frames having at least one positioning boss.

The invention may also be incorporated into a method of providing a similarly aligned embroidery upon a plurality of similarly sized and shaped fabrics having at least one similar reference point from which to establish a particular location point relative the entire fabric comprising providing an apparatus for aligning a fabric comprising a platform with an alignment pattern positioned in a manner to be displayed on the platform. A first hooping frame holding means having at least one notch for alignedly receiving each positioning boss of the hooping frame is disposed on the platform. The first hooping frame holding means alignedly receives the hooping frame relative to a corresponding alignment mounting in a second hooping frame holding means of an embroidery machine having at least one notch for alignedly receiving each positioning boss of the hooping frame. A target alignment pattern with a cross hair pattern is positioned in a manner to be displayed through an opening of the hooping frame when the hooping frame is positioned therein. A method of providing an aligned embroidery upon a fabric is conducted by first aligning a second hooping frame holding means positioned on an embroidery machine such that the second hooping frame holding means on the embroidery machine receives the hooping frame in the same specific orientation as the first hooping frame holding means positioned on the platform by first posi tioning the hooping frame having a cross hair pattern displayed in the opening of the hooping frame in alignment with the cross hair pattern displayed on the first hooping frame holding means positioned on the platform and rotating the hooping frame positioned within the second hooping frame holding means until the cross hair pattern displayed within the opening of the hooping frame held within the second hooping frame holding means alignedly matches the two intersecting straight-line axes defined by a corner of a needle plate of the embroidery machine. The hooping frame is secured within the second hooping frame holding means to prevent rotation of the hooping frame relative to the orientation of the needle plaate. The needle of the embroidery machine is then aligned relative the origin of the cross hairs displayed within the opening of the hooping frame. The position of the needle relative to the origin of the cross hairs is then secured. An alignment of at least one fabric for the placement of an aligned embroidery thereon is conducted by placing a hooping frame having the same peripheral wall configuration used to align the second hooping frame holding means of the embroidery machine into the first hooping frame holding means positioned on the platform. A fabric is positioned over the hooping frame. The fabric positioned on the platform is aligned relative to at least one reference point of the fabric by utilizing the target alignment pattern displayed on the platform to position the intended embroidery at the desired position relative to the entire fabric while simultaneously positioning the intended embroidery in an aligned manner relative to the cross hairs displayed on the first hooping frame holding means to align the fabric relative to the origin of the cross hairs displayed on the first hooping frame holding means which is aligned with the needle of the embroidery machine thereby aligning the intended embroidery relative the entire fabric and in the desired orientation upon the fabric. The fabric is then secured in the hooping frame. The hooping frame securing the fabric is positioned into the hooping frame of the embroidering machine. An aligned embroidery is then embroidered on the fabric.

More specifically, the second hooping frame holding means is aligned relative to the first hooping frame holding means by first positioning an outer hoop into the first hooping frame holding means and placing a backing on top of the outer hoop and inserting the inner hoop against the backing and into the outer hoop to secure the backing within the outer hoop of the hooping frame. A horizontal line or "X" axis is drawn on the backing and a vertical line or "Y" axis is also drawn on the backing to provide a rotational correspondence of the hooping frame when positioned in the second hooping frame holding means. The stop-start point of the intended embroidery is marked on the backing. The backing secured hooping frame is positioned into the second hooping frame holding means. The hooping frame positioned within the second hooping frame holding means on the embroidery machine is rotated until the cross hair pattern displayed within the opening of the hooping frame held alignedly matches the two intersecting straight-line axes defined by a corner of a needle plate of the embroidery machine. The hooping frame is secured within the second hooping frame holding means of the embroidery machine to prevent rotation of the hooping frame relative to the orientation of the needle plate. The needle of the embroidery machine is then aligned relative to either a stop-start point of the intended embroidery, or a start point of the intended embroidery which is usually the origin of the cross hairs displayed within the opening of the hooping frame. The position of the needle relative to the origin of the cross hairs (stop-start point) is then secured. An alignment of a least one fabric for the placement of an aligned embroidery therein is conducted by placing a hooping frame having the same peripheral wall configuration used to align the second hooping frame holding means of the embroidery machine into the first hooping frame holding means positioned on the platform. A fabric is positioned over the hooping frame. The fabric positioned on the platform relative to at least one reference point of the fabric is aligned by utilizing the target alignment pattern displayed on the platform to position the intended embroidery at the desired position relative to the entire fabric while simultaneously positioning the intended embroidery in an aligned manner relative to the cross hairs displayed on the first hooping frame holding means to align the fabric relative to the (stop-start point) origin of the cross hairs displayed on the first hooping frame holding means which is aligned with the needle of the embroidery machine thereby aligning the intended embroidery relative the entire fabric and in the desired orientation upon the fabric. The fabric is secured in the hooping frame. The hooping frame securing the fabric is positioned into the hooping frame of the embroidering machine and an aligned embroidery is embroidered on the fabric.

An alternative to preparing a target alignment pattern as described above is to utilize an outer hoop with a transparent film covering the opening where the film includes the target alignment pattern printed thereon.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DISCUSSION

Figure 1:
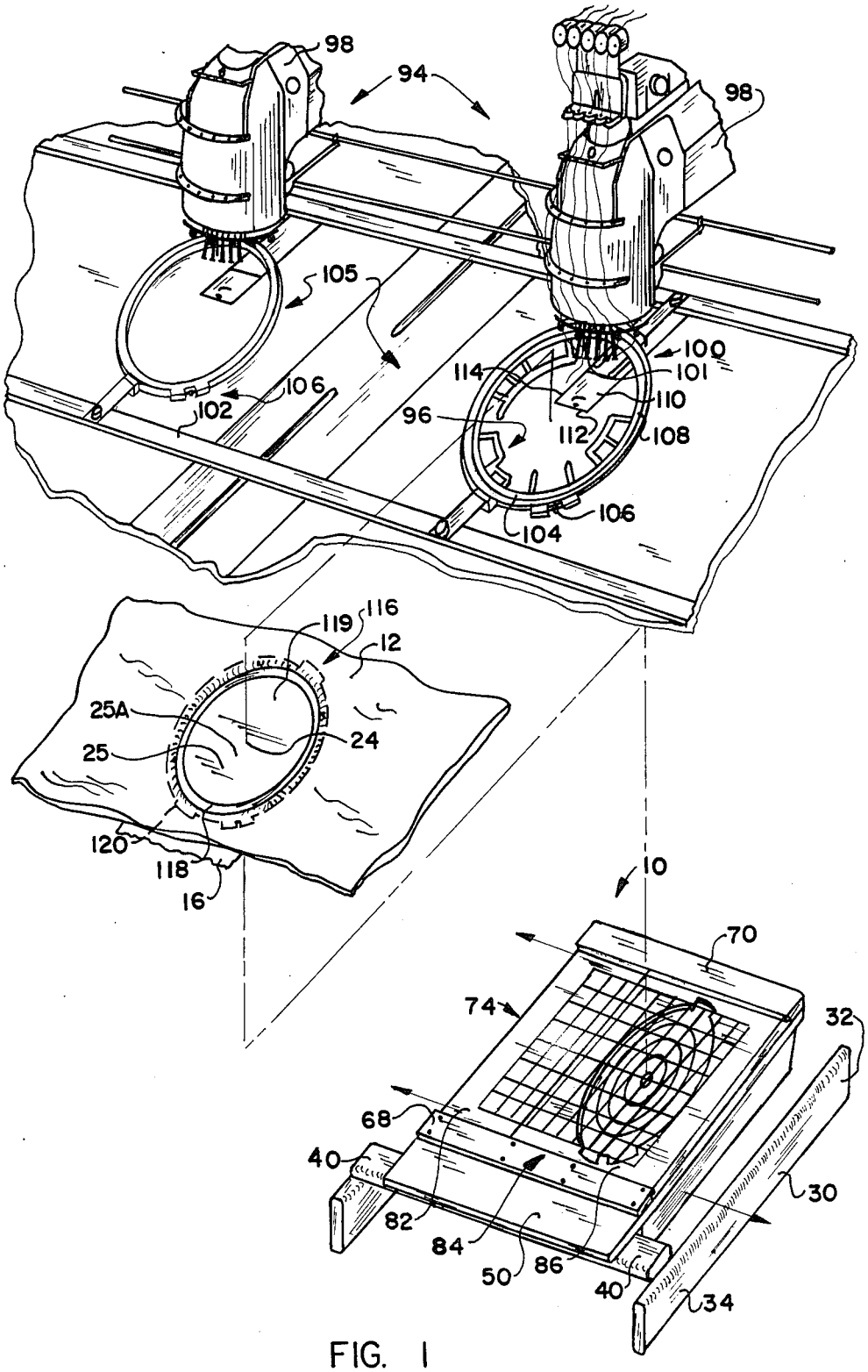
FIG. 1 is an isometric view of the apparatus of the invention.

FIG. 1 is a partial perspective view of an embroidery machine 94 comprising an embroidery head 98 having a plurality of needles 100. Although a specific example has been shown for the embroidery machine 94, the machine, per se, does not form a part of the invention as will be apparent hereinafter. The embroidery machine 94 includes a rack 102 which secures a plurality of hoop holders 105. Each hoop holder 104 of the plurality of hoop holders 105 in turn secures quick change hoop insert 108 which secures a hooping frame 116. The rack 102 moves each hooping frame 116 under the sewing head in order to enable the needles 105 to embroider an embroidery within an area 119 defined by the hooping frame 116. The hoop holder 104 is mounted in the rack 102 in line with each sewing head. The hoop holder 104 has a specific configuration to receive at least one positioning boss 122 of an outer hoop 120 of a hooping frame 116 in a fixed orientation relative to the positioning boss 122. The hoop holder 104 may further include an adjustment screw 106 to increase or decrease the circumference of the hoop holder 104 thereby rotationally securing or loosening the hooping frame or the quick change insert 108 positioned therein. Preferably, the hoop holder further includes a quick change hoop insert 108 which allows the hooping frame 116 to be inserted and removed quickly without manipulating the adjustment screw 106 of the hoop holder 104. Quick change hoop insert 108 also allows the outer hoop 120 to be rotated within the hoop holder 104 in order to change the orientation of the positioning boss 122 of the outer hoop 120 to enable the positioning of the outer hoop 120 relative to the needle plate 110 and the activated sewing needle 101. The inner hoop 118 and outer hoop 120 hold the fabric 12 and backing 16 taut and stationery for the placement of an embroidery on the fabric. The fabric 12 is positioned over the outer hoop 120 with the inner hoop 118 being received within the inner perimeter 121 of the outer hoop 120 to secure the fabric 12. The hooped fabric 12 is positioned in the hoop holder 104 of the embroidery machine 94. The quick change hoop insert 108 of the embroidery machine 94 is in alignment with the hoop holding means 82 of the apparatus 10. The fabric aligning apparatus of the invention 10 comprises a frame 30 supporting a platform 50. The platform 50 includes a fabric alignment pattern 74 positioned in a manner to be displayed on the platform 50. Generally, the fabric alignment pattern 74 is printed on the upper surface 60 of the platform 50. However, the fabric alignment pattern 74 may also be projected onto the surface of the platform 50 by a projection device positioned above the apparatus thereby enabling the fabric alignment pattern 74 to be viewed by the user of the apparatus. A target alignment pattern 84 is positioned in a manner to be displayed through the opening 116A of the hooping frame 116 when the hooping frame is alignedly positioned in the first hooping frame holding means 82 of the apparatus 10.

To align the second hooping frame holding means 96 of the embroidery machine 94 with the first hooping frame holding means 82 of the apparatus 10 an outer hoop 120 is alignedly positioned into the opening 93 formed in the first hooping frame holding means 82 of the fabric aligning apparatus 10. A backing fabric 16 is then positioned over the outer hooping frame 120. An inner hoop 118 of the hooping frame 116 is securely received into the inner periphery 121 of the outer hoop 120. A stop-start point of the intended embroidery 24 is then marked on the backing 16. The stop-start point 24 may be positioned at any location on the backing 16 as directed by a computer program. The usual practice is to position the stop-start point 24 within the area 119 defined by surface area within the hooping frame 116. Furthermore, it is the usual practice to position the stop-start point 24 at the center point 26 of the inner hoop 118 of the hooping frame 116. Target alignment pattern 84 positions the center point 26 and the origin point 83 of the intersecting "X" axis 46 and "Y" axis 48 at the same point. After the stop-start 24 has been marked on the backing 16 the "X" axis 46 and "Y" axis 48 are then drawn on the backing 16.

To align the embroidery machine 94 with the apparatus of the invention, the marked and hooped backing is positioned in the second hooping frame holding means 96 of the embroidery machine 94. The "X" 46 and "Y" 48 axis obtained from the apparatus 10 are positioned relative to the needle plate 110 of the embroidery machine 94. The corner of needle plate 110 includes two perpendicularly intersecting straight-line axes 112 ("X" axis) and 114 ("Y" axis) of the embroidery machine 94 to provide alignment corresponding to the marked backing. Simultaneously, the needle 101 of the embroidery machine 94 is aligned with the stop-start point 24 marked on the backing 16. This procedure aligns the first hooping frame holding means 82 of the apparatus 10 with the second hooping frame holding means 96 of the embroidery machine 94 and furthermore aligns the stop-start point of the intended embroidery pattern 24 with the needle 101 of the embroidery machine 94. In the event that the stop-start point 24 and the origin point 83 are not at the same location, the stop-start point 24 is marked at its particular location one the fabric backing. Needle 101 is set relative to the particular location as will be shown below.

Some embroidery patterns use a first start point 25 and a second stop point 25A which are spaced apart from each other. In this event, the needle is aligned with the start point.

Figure 2:
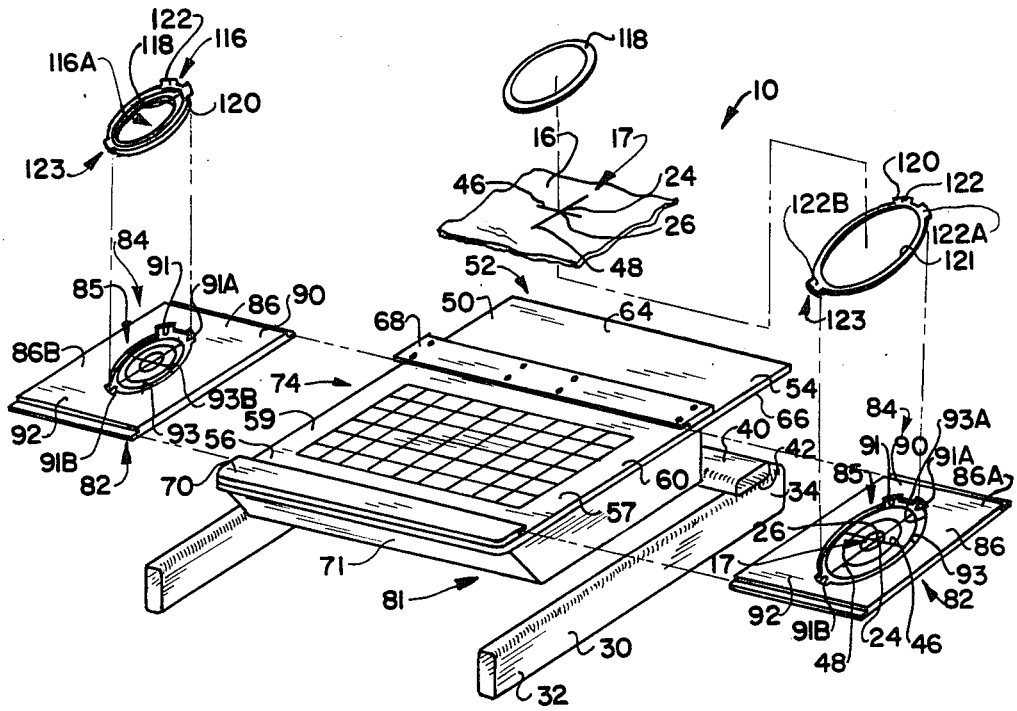
FIG. 2 is an exploded view of the apparatus of the invention.

FIG. 2 illustrates the fabric aligning apparatus 10 comprising a frame 30 having a first end 32 and a second end 34 and an upright member 40 having a first end 42 and a second end 44. The first end 42 of the upright member 40 is positioned at the second end 34 of the frame 30. The upright member 40 extends vertically from the frame 30 to support a platform 50 at its second end 44. The platform 50 includes a first end 54 and a second end 56 with the first end 54 of the platform 50 supportedly positioned at the second end 44 of the upright member 40. This enables the platform 50 to extend in a horizontal plane 52 and also enables the platform 50 to be spaced apart 81 from the frame to enable the passage of the fabric 12 between the frame 30 and platform 50. Passageway 81 is especially useful in the ascertainment of the position of an intended embroidery pattern 29 where the fabric is of a tubular shape such as a shirt, blouse, t-shirt, jacket and the like. The passageway 81 allows for the garment to be easily received on the platform by allowing the lower portion of the tubular shaped fabric to be received therein. The platform 10 further includes an upper side 64 and a lower side 66. An alignment pattern 74 is positioned on the platform 50 in such a manner as to be displayed on the platform 50. Any means which illustrates the alignment pattern 74 on the platform 50 is considered within the scope of the invention. Such means include a lighted projection of the alignment pattern 74 onto the upper surface 60 of the platform 50 or a lighted alignment pattern, e.g. neon, positioned within the platform 50.

The upper surface 60 of the platform 50 further includes a first rail 68 and a second rail 70 spaced apart in a parallel manner in order to slidably receive the first hoop holding means 82 of the apparatus 10. More specifically, the first hooping frame holding means 82 is a plate 86 having an opening 93 formed therein in the shape of a hooping frame 116. The opening 93 formed in the plate 82 of the first hooping frame holding means 82 includes at least one notch 91 to alignedly receive each positioning boss 122 of the outer hoop 120 of the hooping frame 116. Accordingly, opening 93 formed in the plate 86 includes notches 91, 91A and 91B which correspond with positioning bosses 122, 122A and 122B, respectively, of outer hoop 120 of hooping frame 116. The plate 86 includes a first end 90 and a second end 92. A first rail 68 is positioned on the upper surface 60 of the platform proximate the first end 54 of the platform 50. The second rail 70 is positioned on the upper surface 60 of the platform proximate the second end 56 of the platform 50. The first end 90 and second end 92 of the plate 86 is slidably and glidably received by the first 68 and second 70 rails, respectively. The exact positioning of the plate 86 along the first 68 and second 70 rails of the platform 50 is determined by the intended positioning of the embroidery on a fabric. For example, for placement of an embroidery on the left side of a shirt, plate 86 would be positioned proximate the third end 57 of the platform. Conversely, for placement of an embroidery on the right side of a shirt, plate 86 is positioned proximate the fourth end 59 of the platform.

FIG. 2 further illustrates a first 86A and second 86B plate of the hoop holding means 82 of the apparatus 10. Plate 86A and 86B have different size opening 93A and 93B formed therein to receive the different shaped and/or sized hooping frames for different sized embroideries. In most instances only a single plate 86 will be positioned of platform 50 at any one time. When two embroidery patterns are to be spaced apart on a single fabric, a plate for each embroidery may be positioned on the platform 50 to enable consecutive alignment hooping of the fabric relative to each plate. This would enable, for example, an embroidered company name proximate a left shirt pocket and a company logo proximate a right shirt pocket. The hooping process would first be completed for each side for each shirt. Then, one side of all the shirts would be embroidered with the logo followed by embroidering of the remaining side of all the shirts with the company name.

Figure 3:
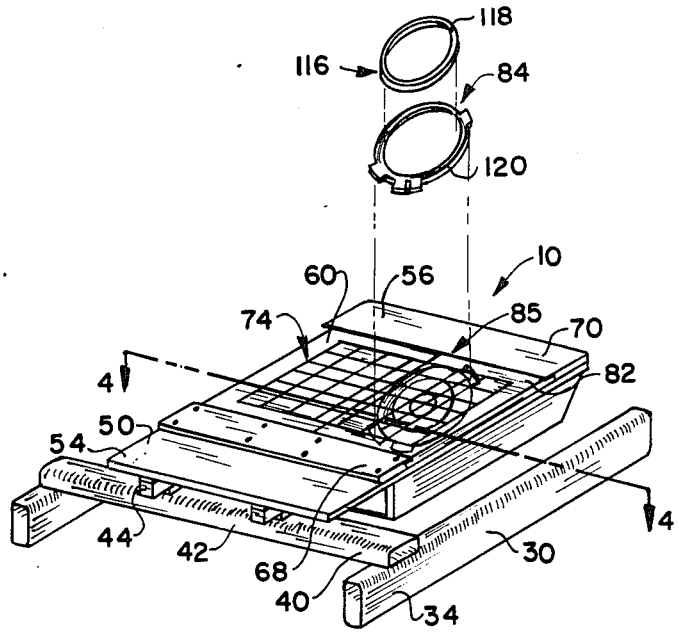
FIG. 3 is a front view of the apparatus of the invention.

FIG. 3 is a front isometric view of the apparatus 10 illustrating frame 30 having an upright member 40 positioned at the second end 34 of the frame 30. The upright member 40 includes a first end 42 and a second end 44 with a platform 50 being secured at the second end 44 of upright member 40. The platform further includes a first end 54 and second end 56. A fabric alignment pattern 74 is positioned on the upper surface 60 of the platform. The fabric alignment pattern 74 cooperates with the cross hair pattern 85 of the first hooping frame holding means 82 of the apparatus 10. The cross hair pattern 85 is best illustrated at FIG. 2 which illustrates plates 86A and 86B having a cross hair pattern 85 positioned in a manner to enable the display of the cross hair pattern 85 through the opening 93A, 93B formed in plates 86A, 86B, respectively.

FIG. 3 also illustrates outer hoop 120 a transparent film 125 covering the opening of the outer hoop. The film 125 includes the target alignment pattern 84 printed thereon. Film 125 may be releasably secured to the outer hoop or may be permanently attached thereto in which case the hoop could only be used to align the second hooping frame holding means.

Figure 4:
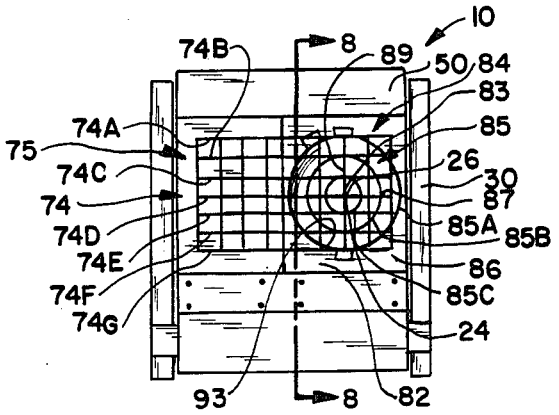
FIG. 4 is a top view of the apparatus of the invention.

FIG. 4 illustrates the cross hair pattern 85 appearing through the opening 93 formed in the plate 86 of the first hooping frame holding means 82 of the apparatus 10 in cooperation with the fabric alignment pattern 74. As illustrated, the horizontal lines 74A–74G of the fabric alignment pattern 74 are in alignment with the concentric circles 85A–85C of the cross hair pattern 85 of the hoop holding means 82 of the apparatus 10. The horizontal lines 74C and 74E are tangent to circle 85C; horizontal lines 74B and 74F are tangent to circle 85B and horizontal lines 74A and 74G are tangent to circle 85A. Having the horizontal lines of pattern 74 tangently intersect the top and bottom, as illustrated at FIG. 4, of each circle of the target pattern vastly decreases the time needed to align each fabric on the apparatus. Unexpectedly, the training time to accurately utilize the apparatus 10 is also vastly decreased relative to an apparatus without the patterns 74 and 84 and especially when the cross hair pattern 85 is included. When the cross hair pattern 85 is included, the "X" axis 87 of the cross hair pattern 85 is in alignment with horizontal line 74D of the fabric alignment pattern 74. The "Y" axis 89 of the cross hair pattern 85 may be alignedly positioned with the vertical lines 75 of the fabric alignment pattern 74. The center point 26 of the concentric circles 85A–85C of the cross hair pattern 85 all have the same origin point 83.

Figure 5A:
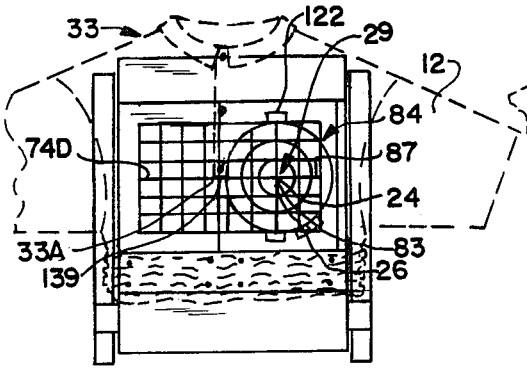
FIG. 5A is a top view of the apparatus of the invention with a garment positioned thereon in correct alignment.
Figure 5:
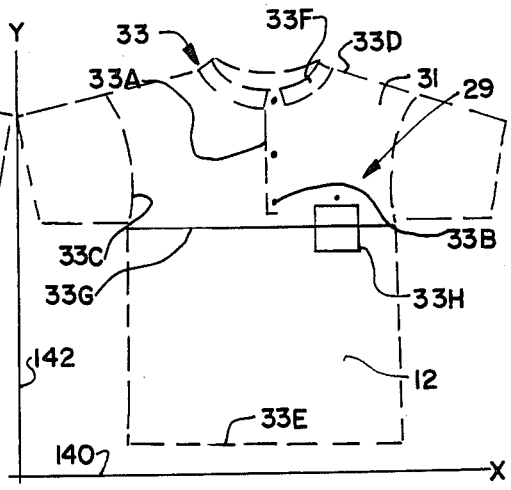
FIG. 5 is a front view of a fabric to be aligned 12 prior to positioning the fabric on the apparatus of the invention.

FIG. 5 illustrates a fabric to be aligned 12, shirt 31, in order to place an embroidery pattern at an intended embroidery position 29. Care must be taken to alignedly place the intended position 29 such that the position 29 is not vertically misaligned along the "Y" axis of the fabric 142 or is not horizontally misaligned along the "X" axis of the fabric 140. To aid in the proper alignment, certain points of reference 33 of the shirt 31 include placket 33A, shoulder seam 33C, button 33B, top of fabric 33D, bottom of fabric 33E, collar 33F, stripe 33G, pocket 33H and the like are used as discussed below.

FIG. 5A illustrates the correct alignment of the fabric 12 relative to the fabric alignment pattern 74 of platform 50 and the target alignment pattern 84 of the first hooping frame holding means 82 of the apparatus 10.

The fabric to be aligned 12 is positioned on the platform 50 with the fabric alignment pattern 74 and the target alignment pattern 84 being displayed through the fabric 12 preferably utilizing a light source 78 to enhance the alignment patterns 74 and 84. The intended position of the embroidery pattern 29 is positioned at the intersecting lines of the cross hair pattern 85 of the first hooping frame holding means 82. Thus, when the fabric to be aligned 12 is positioned such that the bottom 139 of the placket 33A is positioned along horizontal line 74D of the fabric alignment pattern 74, the fabric to be aligned 12 is aligned along the "X" axis 87 of the target alignment pattern 84 to provide for horizontal alignment of the fabric relative to the intended embroidery position 29. When the intended position 29 of the embroidery pattern is positioned at the point of origin 83 of circles 85A–85C as indicated by intersecting line 74D and vertical line 89, the position of the intended embroidery is aligned along the "Y" axis 89 to provide for vertical alignment of the fabric relative to the intended embroidery position relative to the bottom 139 of the placket 33A. In this illustration, there is no vertical change from the horizontal line 74D. Accordingly, the intended position is at the origin 83 of the cross hair pattern 85 which is also the stop-start point 24 for the embroidery pattern.

Figure 6:
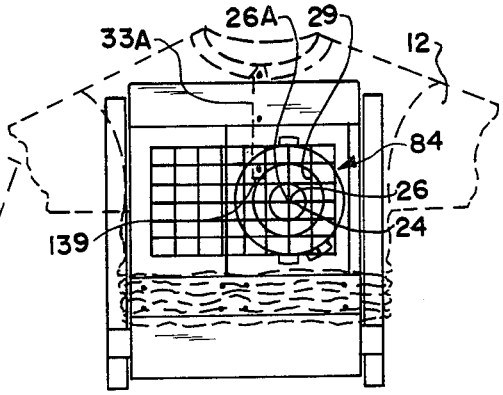
FIG. 6 is a top view of the apparatus of the invention with a garment positioned thereon illustrating the intended embroidery position misaligned with the placket of the garment.

FIG. 6 illustrates the misalignment of the fabric to be aligned 12 relative to the "X" axis 140 (horizontal position) and "Y" axis 142 (vertical position) of the fabric 12. The stop-start point 24 of the embroidery is positioned below the placket 33A and too close to the placket 33A as illustrated by the intended position of the embroidery pattern 29. Thus, given the instructions to position the stop-start point 24 in line with the bottom 139 of placket 33A, the operator of the apparatus 10 can easily properly align the fabric 12 to attain the alignment set forth at FIG. 5.

Figure 7:
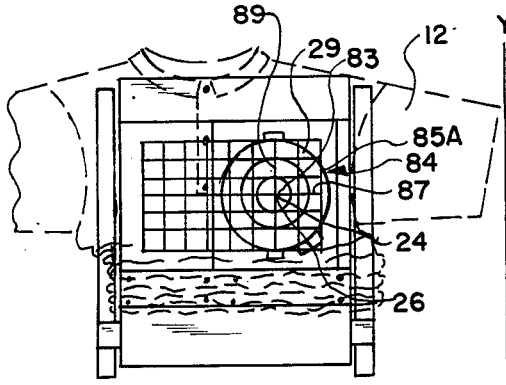
FIG. 7 is a top view of the apparatus of the invention with a garment positioned thereon illustrating the misalignment of the fabric relative to the "X" and "Y" axis of the garment.

FIG. 7 illustrates the fabric to be aligned 12 aligned with reference to the "X" axis 87 of the cross hair pattern 85 which is aligned relative to the "X" axis 140 of the fabric to be aligned 12. In order to position the intended embroidery position 29 on the stop-start point 24, the fabric to be aligned must be moved along the "X" axis 87 until the circle 85A touches placket 33A, as illustrated at FIG. 5A. This maneuver by the operator correctly positions the intended embroidery position 29 over the stop-start point 24. This aligns the fabric to be aligned 12 along the "Y" axis 142 and "X" axis 140 of the fabric. Thus, the embroidery pattern position on the fabric is horizontally and vertically justified.

Figure 8:
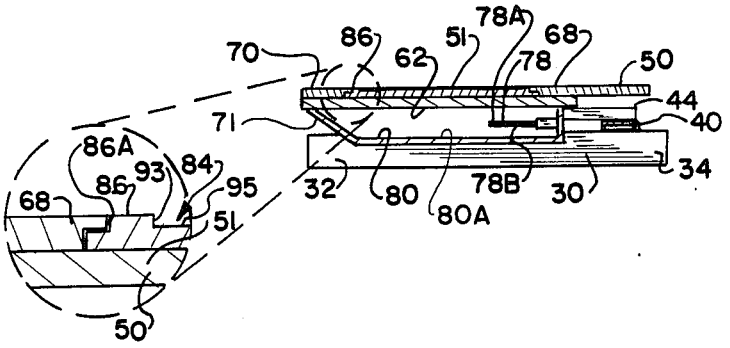
FIG. 8 is a sectional view of FIG. 4.

FIG. 8 illustrates a sectional view taken along line 8—8 of FIG. 4. Preferably, the apparatus of the invention 10 includes a fabric deflection member 71 positioned at the second end 56 of the platform 50 which extends downwardly relative the platform 50 from the lower surface 62 of the platform 50. A light source 78 is positioned proximate the lower surface 62 of the platform 50. Preferably, the light source 78 includes a proximate portion 78A and a distal portion 78B. The light source 78 is positioned adjacent to the lower surface 62 of the platform 78. A reflective means 80 such as a mirror 80A is positioned proximate the distal portion 78B of the light source 78 to reflect the intensity of light generated by the light source 78 through the transparent platform 51 and a plate 86 which is transparent. An exploded view better illustrates first rail 68 of the platform 50 slidably and guidably engaging the first end 90 of plate 86. Preferably, target alignment pattern 84 is printed on the bottom 95 of the opening 93 formed in the plate 86.

Figure 9:
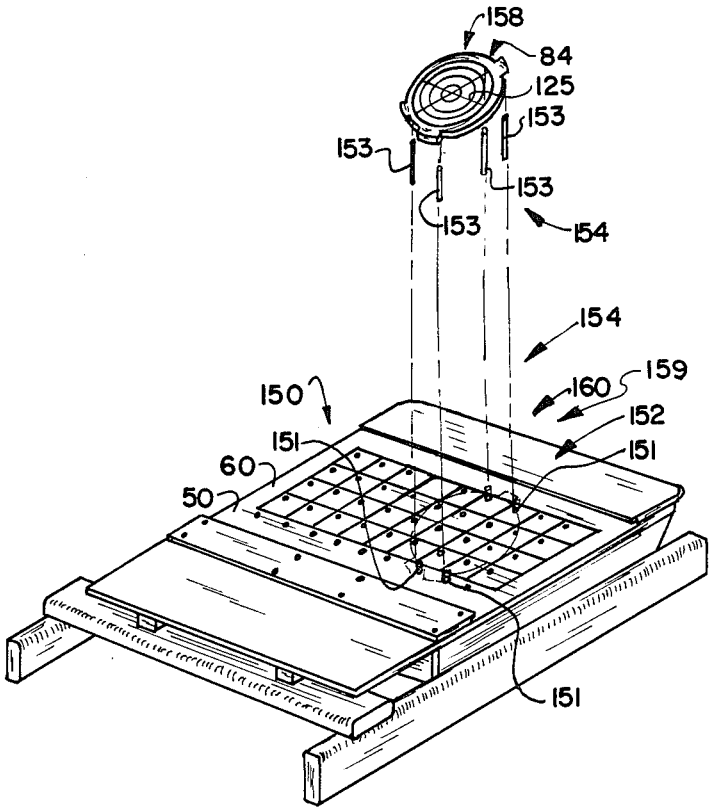
FIG. 9 is an isometric view of another embodiment of the invention.

FIG. 9 illustrates a further embodiment of the invention where the upper surface 60 of the platform 50 further includes a plurality of apertures 150. A first portion 152 of said plurality of apertures 150 defines a first hooping frame shape 158 of a plurality of hooping frame shapes 160. A pluralty of posts 154 are provided. Each aperture 151 of the first portion of apertures 152 of the plurality of apertures 150 formed in the upper surface 60 of the platform receives a post 153 thereby forming an outline 159 of the first hooping frame shape 158. The outline 159 alignedly receives the hooping frame shape 158. The target alignment pattern 84 is positioned on the upper surface of platform 50. In this embodiment, the target alignment pattern 84 is displayed on a film 125 which releasably adheres to the upper surface of platform 50. The film is positioned on platform 50 according to the position of the intended embroidery on the fabric to be embroidered.

In use the apparatus for aligning a fabric prior to securing the fabric in a hooping frame requires the use of a hooping frame 116 having at least one positioning boss 122 on the outer hoop 120. The first hooping frame holding means 82 of the invention 10 and the second hooping frame holding means 96 of the embroidery machine 94 must be first aligned such that the specific configuration of the hooping frame is received in the first hooping frame holding means 82 and second hooping frame holding means 96 of both the embroidery machine 94 and the apparatus 10 in a correspondingly like orientation. Thus, the second hooping frame holding means 96 of the embroidery machine 94 is aligned according to the position of the first hooping frame holding means 82 of the apparatus 10.

Using the apparatus 10 an alignment of a fabric is conducted by first aligning the second hooping frame holding means 96 positioned on the embroidery machine 94 to the specific alignment of the first hooping frame holding means 82 positioned on the apparatus 10. The first hooping frame holding means 82 of the apparatus 10 receives a hooping frame 116 such that the cross hair pattern 85 of the first hooping frame holding means 82 is displayed through the opening 119 of the hooping frame 116. The cross hair pattern 85 is positioned at the bottom 95 of the opening 93 of the first hooping frame holding means 82. In aligning the embroidery machine 94 a backing 16 is secured into an outer hoop 120 by positioning an inner hoop 118 against the backing 16 and securely positioning the backing into the outer hoop 126. The "X" axis 87 and "Y" axis 89 of the cross hair pattern 85 is then drawn on the backing 16 using as the stop-start point 24 as the point of origin 26 for the "X" axis 87 and "Y" axis 89. Generally, the point of origin 26 is the center point 26A of the hooping frame. The hooping frame 116 having the "X" and "Y" pattern 17 illustrated on the backing is then positioned into the second hooping frame holding means 96 of the embroidery machine 94. The hooping frame 116 is then rotated within the second hooping frame holding means 96 of the embroidery machine 94 until the positioning boss 122 of the outer frame 120 is in a similar location relative to the position of the notch 91 of the apparatus 10 which receives the positioning boss 122 of the outer hoop 120 of the hooping frame 116. The hooping frame 116 is then further rotated until the "X" and "Y" pattern 17 displayed within the opening 93 of the hooping frame 116 alignedly matches the intersecting straight-line axes, 112 and 114, respectively, defined by the needle plate 110 of the embroidery machine 94. The hooping frame 116 is then secured within the second hooping frame holding means 96 of the embroidery machine 94. This prevents the rotation of the hooping frame 116 relative to the orientation of axes 112 and 114 of the needle plate 110. The needle 101 which is in the working position of the embroidery machine 94 is then aligned relative to the point of origin 26 of a the "X" axis and "Y" axis pattern 17 which is the stop-start point of the intended embroidery 24. The above procedure aligns the second hooping frame holding means 96 of the embroidery machine 94 with the first hooping frame holding means 82 of the apparatus 10. That is, the positioning boss 122 of the outer hoop 120 of the hooping frame 116 is received in the same specific orientation within either the first hooping frame holding means 82 of the apparatus 10 or the second hooping frame holding means 96 of the embroidery machine 94. For example, the use of a hooping frame 116 having an outer hoop 120 with a positioning boss 122 positioned at an eleven o'clock position and a second positioning boss 122A positioned at a six o'clock position will be received in the first hooping frame holding means 82 of the apparatus 10 and the second hooping frame holding means 96 of the embroidery machine 94 such that the eleven o'clock and six o'clock positioning bosses of the hooping frame 116 have the same orientation.

Alignment of a fabric 12 in order to place an aligned embroidery on the fabric is accomplished by placing an outer hoop of a 120 hooping frame 116 with the same outer hoop configuration 123 used to align the second hooping frame holding means 96 of the embroidery machine 94 into the first hooping frame holding means 82 positioned on the platform of the apparatus. A fabric backing 16 is usually used to strengthen the placement of the embroidery to the fabric. The fabric backing is first placed over the outer hoop 120. The fabric 12 is then positioned over the outer hoop 120 of the hooping frame 116. The fabric 12 is aligned by manipulating the fabric relative to at least one reference point of the fabric. Such reference points of the fabric includes seams, stripes, pocket, placket or the like. Utilizing the alignment pattern 74 positioned on the platform 50 positions the intended embroidery at the desired position relative to the entire fabric. For example, if an embroidery were to be positioned on a t-shirt having a plurality of equally spaced horizontal stripes and a pocket, the garment would be positioned in a manner such that the alignment pattern would be visible through the shirt. The shirt is manipulated until a predetermined stripe is positioned along a predetermined, horizontal line 74E of the fabric alignment pattern 74. This aligns the intended embroidery relative to the horizontal placement onto the t-shirt. The t-shirt is now manipulated by moving the shirt either in a right or left direction while maintaining the reference point 33, the horizontal stripe, along the horizontal line of pattern 74. That is, the t-shirt is neither moved in an upward nor downward direction. A position for the intended embroidery is centered one inch above a pocket which is line 74D. Viewing the cross hair pattern, the t-shirt is moved in either a right or left direction until the stop-start point 24 is positioned at a location with is centered over the pocket. Other reference points could be, for example, a shoulder seam, collar, placket or the like.

The present disclosure includes that contained in the appended claims as well a that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for aligning a fabric prior to securing the fabric in a hooping frame having at least one positioning boss comprising:

a platform;

a first hooping frame holding means having at least one notch for alignedly receiving each positioning boss of the hooping frame;

said first hooping frame holding means being disposed on said platform for alignedly receiving in use the hooping frame relative to a corresponding alignment mounting in a second hooping frame holding means of an embroidery machine having at least one notch for alignedly receiving each positioning boss of the hooping frame; and a target alignment pattern positioned in a manner to be displayed through an opening of the hooping frame when the hooping frame is positioned in said first hooping frame holding means to enable in use the fabric to be aligned when the fabric is positioned relative to a predetermined point on said target alignment pattern prealigned with an embroidery needle of the embroidery machine while the hooping frame is simultaneously held by said first hooping frame holding means in said alignedly receive position to enable exact positioning of an embroidery at said predetermined point prealigned with the embroidery needle of the embroidery machine when the fabric is secured in the hooping frame positioned in said first hooping frame holding means disposed on said platform and the hooping frame which secures the fabric is then positioned in said correspondingly aligned second hooping frame holding means of the embroidery machine and the fabric is embroidered.

2. The apparatus of claim 7 wherein said light source includes a proximate portion and a distal portion wherein said proximate portion is positioned adjacent said surface of said platform; and a reflective means positioned at said distal portion of said light source to reflect the intensity of the light generated by said light source through said transparent platform thereby further enhancing the display of said target alignment pattern through the fabric to enable in use rapid alignment of said fabric in the hooping frame relative to the embroidery head of the embroidery machine.

3. The apparatus of claim 2 wherein said platform includes a first end and a second end;

said fabric alignment pattern defines a grid pattern comprising a plurality of horizontal lines wherein said lines are horizontal relative to said first end and said second end of said platform;

said horizontal lines being uniformly spaced and parallel relative to an adjacent horizontal line of said plurality of horizontal lines; and a plurality of lines with each line of said plurality of lines being uniformly spaced and parallel relative to an adjacent line of said plurality of lines and each said line perpendicularly intersecting each said horizontal line of said plurality of horizontal lines.

4. The apparatus of claim 3 wherein the target alignment pattern includes a cross hair pattern positioned in a manner to be displayed in use through said opening of the hooping frame when the hooping frame is positioned in said first hooping frame holding means disposed on said platform; and a plurality of different sized concentric circles originating from a point of origin of the cross hair pattern such that each concentric circle of said plurality of different sized concentric circles tangently intersects two of said horizontal lines of said plurality of horizontal lines of said fabric alignment pattern.

5. The apparatus of claim 2 wherein said platform is transparent to light.

6. The apparatus of claim 5 further including a light source to enhance in use the display of said target alignment pattern through the fabric thereby enhancing the observation of said target alignment pattern and said alignment pattern through the fabric being aligned.

7. The apparatus of claim 6 wherein said platform further includes an upper surface and a lower surface; and said light source being positioned proximate said lower surface of said platform to permit light generated by said light source to pass through said transparent platform.

8. The apparatus of claim 7 wherein said light source includes a proximate portion and a distal portion wherein said proximate portion is positioned adjacent said surface of said platform; and a reflective means positioned at said distal portion of said light source to reflect the intensity of the light generated by said light source through said transparent platform thereby further enhancing the display of said target alignment pattern through the fabric.

to enable in use rapid alignment of said fabric in the hooping frame relative to the embroidery head of the embroidery machine.

9. The apparatus of claim 1 wherein said first hooping frame holding means defines a transparent plate having an opening formed therein in the shape of the hooping frame in order to alignedly receive the hooping frame therein;

said plate further includes a first end and a second end;

said platform includes an upper surface and a lower surface;

said upper surface of said platform further includes a first end and a second end;

a first and a second guide rail positioned at said first end and said second end of said platform, respectively, to slidably and guidably receive said first end and said second end of said plate therebetween to enable said plate to move in a plane parallel to said upper surface of said platform.

10. The apparatus of claim 9 wherein said plate and said platform are transparent to light; and a light source positioned at said lower surface of said platform to enhance in use the display of said target alignment pattern through the fabric thereby enhancing the observation of said target alignment pattern and said alignment pattern through the fabric being aligned.

11. The apparatus of claim 1 wherein said platform includes an upper surface and a lower surface;

said upper surface of said platform further includes a plurality of apertures formed therein such that in use a first portion of said plurality of apertures defines a first hooping frame shape of a plurality of hooping frame shapes;

a plurality of posts such that in use each aperture of said first portion of apertures of said plurality of apertures formed in said upper surface of said platform receives a post of said plurality of posts thereby forming an outline of said first hooping frame shape to alignedly receive said first hooping frame shape therein.

12. The apparatus of claim 6 wherein said platform includes a first end and a second end and further includes a lower surface and an upper surface;

a fabric deflection member positioned at said lower surface of said platform proximate said second end of said platform and extending downwardly relative to said platform to prevent in use the fabric to be aligned from becoming hooked on said lower surface of said platform.

13. An apparatus for aligning a fabric relative to an embroidering needle of an embroidery machine to enable a selection of a predetermined position of an embroidery on the fabric and a selection of a predetermined orientation of the embroidery on the fabric prior to securing the fabric in a hooping frame having at least one positioning boss comprising:

a frame having a first end and a second end;

an upright member having a first end and a second end;

said first end of said upright member positioned at said second end of said frame and extending vertically from said frame;

a platform having a first end and a second end;

said first end of said platform supportably positioned at said second end of said upright member such that said platform extends in a horizontal plane and is spaced apart from said frame to enable in use the passage of a portion of the fabric between said frame and said platform when the remaining portion of the fabric is alignedly positioned of said platform;

said platform having an upper surface and a lower surface;

said platform having an alignment pattern positioned in a manner to be displayed on said platform;

a first hooping frame holding means having at least one notch for alignedly receiving each positioning boss of the hooping frame;

said first hooping frame holding means being disposed on said platform for alignedly receiving in use the hooping frame relative to a corresponding alignment in a second hooping frame holding means of an embroidery machine having at least one notch for alignedly receiving each positioning boss of the hooping frame; and a target alignment pattern positioned in a manner to be displayed through an opening of the hooping frame when the hooping frame is positioned in said first hooping frame holding means to enable in use the fabric to be aligned when the fabic is positioned relative to at least one reference point on the fabric and with at least one point on said alignment pattern thereby enabling an ascertainment of the position of the intended embroidery as defined by the point on said target alignment pattern prealigned with the embroidery needle of the embroidery machine thereby enabling placement of an aligned embroidery on the fabric when the fabric is secured in the hooping frame and the hooping frame which secures the fabric is positioned in said correspondingly aligned second hooping frame holding means of the embroidery machine and the fabric is embroidered.

14. The apparatus of claim 13 further including a light source positioned at said lower surface of said platform to enhance in use the display of said target alignment pattern through the fabric thereby enhancing the observation of said target alignment pattern and said alignment pattern through the fabric being aligned;

said first hooping frame holding means defines a transparent plate having an opening formed therein in the shape of the hooping frame in order to alignedly receive the hooping frame therein;

said plate further includes a first end and a second end;

said platform includes an upper surface and a lower surface;

said upper surface of said platform further includes a first end and a second end;

a first and a second guide rail positioned at said first end and said second end of said platform, respectively, to slidably and guidably receive said first end and said second end of said plate therebetween to enable said plate to move in a plane parallel to said upper surface of said platform;

said platform includes a first end and a second end; and a fabric deflection member positioned at said lower surface of said platform proximate said second end of said platform and extending downwardly relative to said platform to prevent in use the fabric to be aligned from becoming hooked on said lower surface of said platform.

15. The apparatus of claim 2 wherein said platform is transparent to light and includes an upper surface and a lower surface;

a light source positioned at said lower surface of said platform to enhance in use the display of said target alignment pattern through the fabric thereby enhancing the observation of said target alignment pattern and said alignment pattern through the fabric being aligned;

said first hooping frame holding means defines a plate transparent to light and having an opening formed therein in the shape of the hooping frame in order to alignedly receive the hooping frame therein;

said plate further includes a first end and a second end;

said platform includes an upper surface and a lower surface;

said upper surface of said platform further includes a first end and a second end;

a first and a second guide rail positioned at said first end and said second end of said platform, respectively, to slidably and guidably receive said first end and said second end of said plate therebetween to enable said plate to move in a plane parallel to said upper surface of said platform;

said platform includes a first end and a second end; and a fabric deflection member positioned at said lower surface of said platform proximate said second end of said platform and extending downwardly relative to said platform to prevent in use the fabric to be aligned from becoming hooked on said lower surface of said platform.

16. A method of providing a similarly aligned embroidery upon a plurality of similarly sized and shaped fabrics having at least one similar reference point proximate the intended embroidery from which to establish a particular location point relative to the entire fabric comprising:

providing an apparatus for aligning a fabric comprising a platform with a first hooping frame holding means having at least one notch for alignedly receiving each positioning boss of the hooping frame and with the first hooping frame holding means being disposed on the platform for alignedly receiving the hooping frame relative to a corresponding alignment mounting in a second hooping frame holding means of an embroidery machine having at least one notch for alignedly receiving each positioning boss of the hooping frame and including a target alignment pattern having a cross hair pattern positioned in a manner to be displayed through an opening of the hooping frame when the hooping frame is positioned therein; and conducting a method of providing an aligned embroidery upon a fabric by first aligning a second hooping frame holding means positioned on an embroidery machine such that the second hooping frame holding means on the embroidery machine receives the hooping frame in the same specific orientation as the first hooping frame holding means positioned on the platform by positioning the hooping frame having the cross hair pattern positioned in the opening of the hooping frame such that the opening of the hooping frame displays a cross hair pattern in alignment with the cross hair pattern displayed on the first hooping frame holding means, by rotating the hooping frame positioned within the second hooping frame holding means until the cross hair pattern displayed within the opening of the hooping frame held within the second hooping frame holding means alignedly matches two perpendicularly intersecting straight-line axes of the embroidery machine as defined by a corner of a needle plate of the embroidery machine;

securing the hooping frame within the second hooping frame holding means of the embroidery machine to prevent rotation of the hooping frame relative to the needle plate;

aligning the needle of the embroidery machine relative to the origin of the cross hairs displayed within the opening of the hooping frame and securing the position of the needle relative to the origin of the cross hairs; and conducting an alignment of at least one fabric for the placement of an aligned embroidery thereon by placing a hooping frame having the same peripheral wall configuration used to align the embroidery machine into the first hooping frame holding means positioned on the platform;

positioning a fabric over the hooping frame;

aligning the fabric positioned on the platform relative to at least one reference point of the fabric by utilizing the fabric alignment pattern displayed on the platform to horizontally position the fabric at the intended embroidery position relative to the entire fabric while simultaneously vertically positioning the fabric at the intended embroidery position in an aligned manner relative to the origin of the cross hair pattern displayed on the first hooping frame holding means which is aligned with the needle of the embroidery machine thereby aligning the embroidered pattern in the desired orientation upon the fabric;

securing the fabric in the hooping frame; and positioning the hooping frame securing the fabric into the second hooping frame holding means of the embroidering machine and embroidering the aligned embroidery on the fabric.

* * * * *

UNITED STATES PATENT AND TRADEMARK OFFICE

CERTIFICATE OF CORRECTION

PATENT NO. : 4,774,778

DATED : October 4, 1988

INVENTOR(S) : Thomas Williams

It is certified that error appears in the above-identified patent and that said Letters Patent are hereby corrected as shown below:

Claim 2, which is identical to claim 8, should be deleted and the original claim 2 inserted as follows:

"2. The apparatus of claim 1 wherein the apparatus further includes a fabric alignment pattern positioned in a manner to be displayed on said platform to enable in use the fabric to be aligned when the fabric is positioned relative to at least one reference point on the fabric and with at least one point on said alignment pattern thereby enabling an ascertainment of the position of the intended embroidery as defined by the point on said target alignment pattern prealigned with the embroidery needle of the embroidery machine."

Signed and Sealed this

Twenty-eighth Day of February, 1989

*Attest:*

DONALD J. QUIGG

*Attesting Officer*

*Commissioner of Patents and Trademarks*